US008297021B2

(12) United States Patent
Quinones

(10) Patent No.: US 8,297,021 B2
(45) Date of Patent: Oct. 30, 2012

(54) SYSTEM FOR CONSTRUCTING AND REINFORCING BLOCK WALL CONSTRUCTION

(75) Inventor: Armando Quinones, La Luz, NM (US)

(73) Assignee: Armando Quinones, La Luz, NM (US)

( * ) Notice: Subject to any disclaimer, the term of this patent is extended or adjusted under 35 U.S.C. 154(b) by 0 days.

(21) Appl. No.: 12/693,302

(22) Filed: Jan. 25, 2010

(65) Prior Publication Data

US 2010/0186335 A1 Jul. 29, 2010

Related U.S. Application Data

(60) Provisional application No. 61/146,961, filed on Jan. 23, 2009, provisional application No. 61/154,558, filed on Feb. 23, 2009, provisional application No. 61/154,634, filed on Feb. 23, 2009, provisional application No. 61/167,704, filed on Apr. 8, 2009.

(51) Int. Cl.
*E04B 1/02* (2006.01)

(52) U.S. Cl. ..... 52/562; 52/568; 52/383

(58) Field of Classification Search ..... 52/426, 52/383, 432, 565, 562, 712, 568, 561, 600, 52/636, 677
See application file for complete search history.

(56) References Cited

U.S. PATENT DOCUMENTS 1,271,447 A * 7/1918 Doern ..... 52/562
1,445,901 A * 2/1923 McKee ..... 52/426
1,962,514 A * 6/1934 MacWilliam ..... 52/715
2,121,943 A * 6/1938 Bem ..... 52/562
2,325,653 A 8/1943 Bingham
2,929,238 A * 3/1960 Kaye ..... 52/690
3,277,626 A * 10/1966 Brynjolfsson et al. ..... 52/713
3,309,828 A * 3/1967 Tribble ..... 52/426
3,342,004 A * 9/1967 Lucas ..... 52/695
3,377,764 A * 4/1968 Storch ..... 52/713
4,229,922 A 10/1980 Clark
4,263,765 A * 4/1981 Maloney ..... 52/562
4,334,397 A 6/1982 Hitz
4,793,104 A * 12/1988 Hultberg et al. ..... 52/127.3
4,865,781 A * 9/1989 Jennings ..... 264/35
4,869,038 A * 9/1989 Catani ..... 52/410
4,939,881 A * 7/1990 Reinle et al. ..... 52/565
5,072,556 A 12/1991 Egenhoefer
5,454,200 A * 10/1995 Hohmann ..... 52/513
5,881,524 A 3/1999 Ellison, Jr.
5,907,937 A 6/1999 Loftus et al.
6,044,594 A * 4/2000 Desselle ..... 52/101
6,195,955 B1 * 3/2001 Kostopoulos ..... 52/741.13
6,553,737 B1 4/2003 Berg
6,629,393 B2 10/2003 Pignataro
6,668,505 B1 * 12/2003 Hohmann et al. ..... 52/565

(Continued)

OTHER PUBLICATIONS

Ho, Clifford K. et al., "Finite Element Analyses of Continuous Filament Ties for Masonry Applications: Final Report for the Arquin Corporation", *Sandia National Laboratories* Sandia Report SAND2006-3750 Jun. 2006 , 1-27.

*Primary Examiner* — Robert Canfield
*Assistant Examiner* — Babajide Demuren

(57) ABSTRACT

An apparatus for and method for constructing and reinforcing modular block construction comprising placing on one or more modular blocks a plurality of separators which are connected via one or more connectors, and aligning modular blocks placed in a layer above the connectors. Also a method and apparatus for constructing and reinforcing multiple concentric modular block walls.

14 Claims, 31 Drawing Sheets

U.S. PATENT DOCUMENTS

| | | | | |
|---|---|---|---|---|
| 6,840,019 | B2 | 1/2005 | Berg | |
| 2004/0020149 | A1* | 2/2004 | Messiqua | 52/426 |
| 2004/0182029 | A1 | 9/2004 | Berg | |
| 2006/0070336 | A1 | 4/2006 | Roberts | |
| 2006/0242921 | A1* | 11/2006 | Massie | 52/309.4 |

* cited by examiner

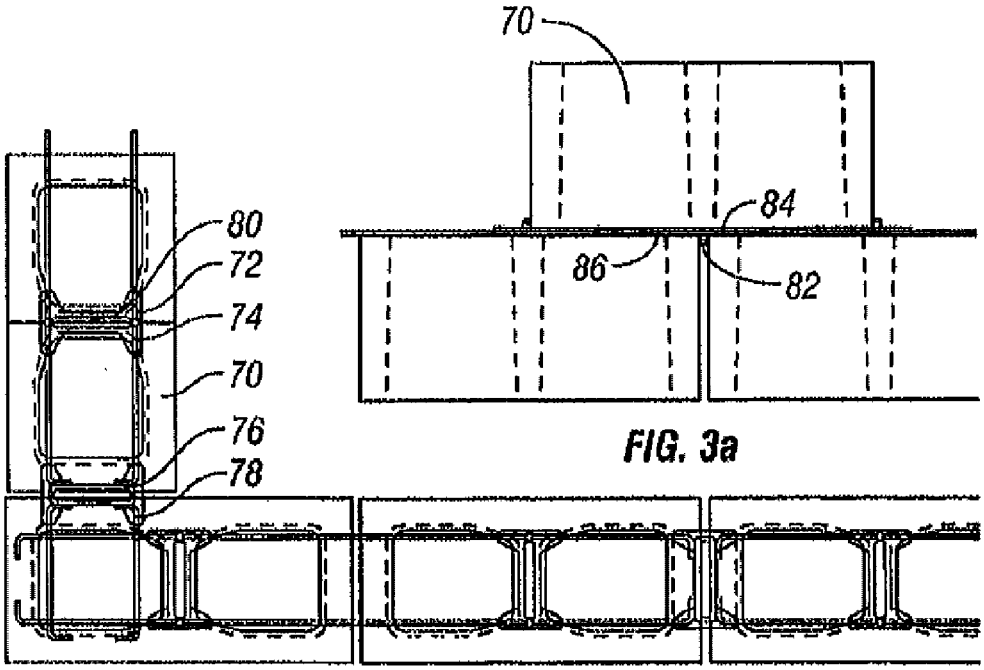
FIG. 3a
FIG. 3b
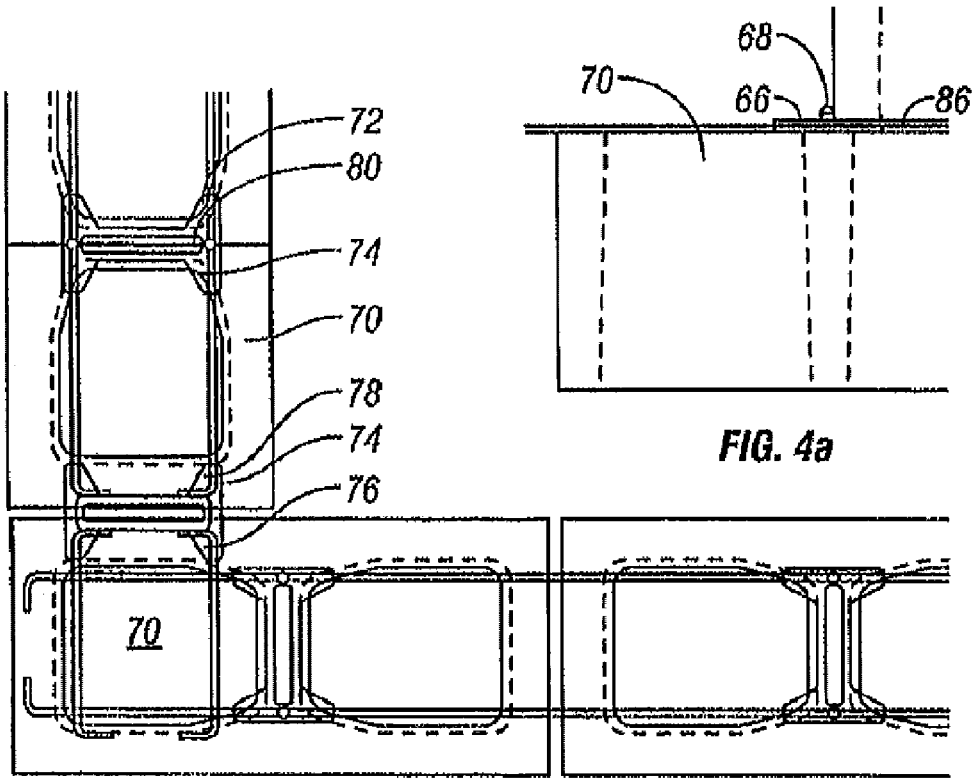
FIG. 4a
FIG. 4b

SYSTEM FOR CONSTRUCTING AND REINFORCING BLOCK WALL CONSTRUCTION

CROSS-REFERENCE TO RELATED APPLICATIONS

This application claims priority to and the benefit of the filing of U.S. Provisional Patent Application Ser. No. 61/146,961, entitled "Multiple Wall Reinforcement Tie", filed on Jan. 23, 2009; U.S. Provisional Patent Application Ser. No. 61/154,558, entitled "Simulation and Testing of a Masonry Wall Comprising Continuous Filament Ties", filed on Feb. 23, 2009; U.S. Provisional Patent Application Ser. No. 61/154,634, entitled "System for Constructing and Reinforcing Block Wall Construction", filed on Feb. 23, 2009; and U.S. Provisional Patent Application Ser. No. 61/167,704, entitled " System for Constructing and Reinforcing Block Wall Construction", filed on Apr. 8, 2009. This application is also related to U.S. patent application Ser. No. 11/462,288, entitled "Apparatus and Method for Stabilizing, Strengthening, and Reinforcing Block/Brick (CMU) Wall Construction", filed on Aug. 3, 2006, which application claims priority to and the benefit of the filing of U.S. Provisional Patent Application Ser. No. 60/706,356, entitled "Apparatus and Method for Constructing and Reinforcing Modular Block Construction", filed on Aug. 5, 2005. The specifications and claims of all these applications are incorporated herein by reference.

BACKGROUND OF THE INVENTION

1. Field of the Invention (Technical Field)

The present invention is of an apparatus and method for rapidly constructing and reinforcing block walls and other constructions.

2. Description of Related Art

Note that the following discussion refers to a number of publications by author(s) and year of publication, and that due to recent publication dates certain publications are not to be considered as prior art vis-à-vis the present invention. Discussion of such publications herein is given for more complete background and is not to be construed as an admission that such publications are prior art for patentability determination purposes.

Existing spacing systems for modular block walls suffer from various deficiencies, including being too complex or structurally too rigid. Examples of other systems are U.S. Patent Publication Nos. 2006/0070336 and 2004/0182029, and U.S. Pat. Nos. 6,840,019, 6,629,393, 6,553,737, 4,793,104, 4,334,397, and 4,229,922.

BRIEF SUMMARY OF THE INVENTION

The present invention is an assembly for constructing and reinforcing parallel walls comprising a modular block construction, the assembly comprising a first wire for periodically contacting an outer wall and an inner wall, a plurality of second wires, each second wire shorter than a width of the modular blocks, and a connector disposed on each end of each second wire. Each second wire is preferably disposed on a first modular block across the width of the first modular block at approximately the location of the vertical joint between two adjacent modular blocks in the layer above the first modular block. The separators preferably automatically align the two adjacent modular blocks during construction of the layer. The location is preferably approximately halfway along a length of the first modular block. The first wire preferably contacts at least some of the second wires at a contact point. The first wire is preferably welded or spot-welded to at least some of the second wires at the contact points. The first wire is preferably substantially perpendicular to each second wire at the contact points. At least a portion of the first wire is preferably disposed over an empty cell of a modular block. The first wire is preferably connected to a rectangular wire loop at a connection point. The rectangular wire loop is preferably disposed across parallel nested adjacent corners of the outer wall and the inner wall and preferably connects the outer wall and the inner wail. The connection point is preferably disposed over an empty cell of a modular block. The rectangular wire loop preferably contacts a plurality of the second wires.

The present invention is also a construction comprising an outer wall comprising a plurality of modular blocks, an inner wall comprising a plurality of modular blocks, a first wire periodically extending between and contacting the outer wall and the inner wall, a plurality of second wires connected to the first wire, and two separators contacting each second wire. At least some of the vertical and/or horizontal joints between modular blocks comprising the outer wall are preferably unmortared. At least some of the vertical and/or horizontal joints between modular blocks comprising the inner wall are optionally un-mortared. The space between the outer wall and the inner wall is preferably at least partially filled with unconsolidated rock, sand, or insulation. Empty cells of at least some of the modular blocks are preferably filled with concrete and/or rebar. Some of the first wire preferably overlaps one or more of the empty cells.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. The dimensions, materials, and specifications described in the drawings illustrate only certain embodiments and may be different for different embodiments. In the drawings:

FIGS. 3*a* and 3*b* are views of the first embodiment used with modular blocks;

FIGS. 4*a* and 4*b* are additional views of the first embodiment used with modular blocks;

DETAILED DESCRIPTION OF THE INVENTION

Figure 1A:
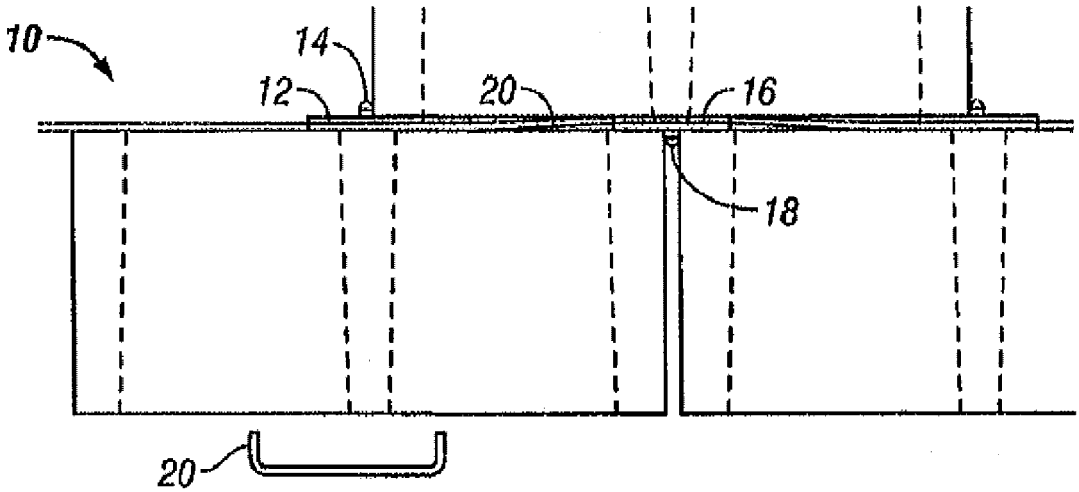
FIGS. 1*a* and 1*b* are views of a first embodiment of the separator/joiner component of the invention.

Embodiments of the present invention comprises a separator and joiner system for the spacing, joining and reinforcement of masonry or other building materials and its method of use. The system is preferably injection molded although other materials/methods can be used. The separator/joiner preferably comprises a rigid, non-porous, water repellent, injection molded material that can support the weight stresses of the materials that it is separating or joining. The separator/joiner may alternatively be manufactured using extruding, stamping, casting, or other methods known in the art. The materials for the separator/joiner include but are not limited to plastic, recycled molded plastic, metals, wood, and/or other materials. The material chosen must be strong enough to support the weight of the modular construction without significantly deforming. A few preferred materials are polypropylene, polyethylene, ABS (plastic styrene), or acrylic, or less preferably PVC or PTFE (Teflon). The present invention preferably comprises a unique rail and clip/pin system that can be utilized in a "separator" or "joiner" configuration, depending on the "pin" position. The pin, as used throughout the specification and claims, is the portion of the preferred embodiment which has been chamfered to ease block placement.

As used throughout the specification and claims, the term "wire" means wire, strand, rod, bar, stock, braided wire, or the like.

Embodiments of the present invention comprise an apparatus for and method for constructing and reinforcing modular block construction, comprising: placing on one or more modular blocks a plurality of chamfered pins; connecting the pins via a plurality of connectors; and aligning via the pins modular blocks placed in a layer above the connectors. The pins may comprise holes or grooves and the connectors comprise rods, wherein the holes or grooves are sized to engagingly receive ends of the rods and a plurality of the pins have two or three holes or grooves receiving three rods, one of the three rods being perpendicular to the other two of the three rods. One or more of the pins may comprise two holes or grooves receiving two rods, the two rods being perpendicular to one another. The pins preferably comprise a rigid, non-porous, water repellent material, such as an injection molded or extruded plastic. The pins are optionally chamfered on two sides of an upwardly extending portion.

As a separator, or in the pin down position, the invention is preferably placed latitudinally between modular blocks and is connected to each modular block by some type of connector. The pin component of the unit uniformly separates the modular blocks. The ends of the invention press into the mating grooves of the modular blocks. As a joiner, or in the pin up position, the invention is preferably placed, latitudinally, inside the unit, and connectors are used to hold at least one modular block on top of another modular block (see FIGS. 1 through 5) and thereby providing a uniform and stable wall unit. Some kind of joining material, including, but not limited to grout, is generally placed between each separated/joined modular block. Because each modular block can be stabilized, it can be worked on as individual modular blocks or multiple modular blocks more efficiently. The advantages are that a very uniform and straight wall unit can be built, the wall unit is stronger because the joining and filling material, e.g. grout fill, is poured all at once and not on top of dried grout (creating a monolithic support), and approximately three times as many blocks can be laid during the same time. The present invention is applicable to any construction using modular blocks, including but not limited to concrete modular units (CMUs), concrete blocks, bricks, plastics, glass, fiberglass, rebar, concrete block substitutes, straw, environmentally friendly modular blocks, adobe, wood, metal, and the like.

The separator/joiner system preferably comprises one or two wires which run on top of the blocks. There is a separator/joiner which is at fixed intervals along the wire and fits between the blocks. The method of use includes, but is not limited to: 1) create a mortar bed, lay the separator/joiner system, and build a first row of blocks; (2) lay the second separator/joiner system and build the second row of blocks, etc.; (3) repeat these steps, etc.; (4) build the entire wall unit without using mortar; (5) pour a joining material down the top holes and a filling material, e.g. grout fill or concrete; and (6) apply joining and filling materials laterally into the side cracks, e.g. spraying mortar or plaster.

A wall unit includes, but is not limited to any building structure having one or more modular blocks, including but not limited to walls, fences, roofs, ceilings, and floors. Joining materials include but are not limited to, grout, fill, mud, cement, caulking, glues, environmentally friendly substitutes, and any similar materials used between modular blocks. Connectors include, but are not limited to clips, wires, pins, poles, and the like. Worked or working on a modular block is any manipulation of the modular block including, but not limited to wiring, plumbing, shoring, stuccoing, framing, and the like. A pour includes, but is not limited to any application of joining or filling material.

The present invention preferably has ends that close and open in order to make possible the connection with the next modular block or separator/joiner. A corner clip may optionally be provided for tying the unit at right angles, when necessary. The present invention is preferably kept in place by connectors. The length, width and size of the present invention vary appropriately to support the building materials.

An alternative bow-tie shaped embodiment of the present invention is shown in FIGS. 1-5. FIG. 1*a* shows the invention in the up position where it is used as separator 12 and in the down position as joiner 16. A separator includes, but is not limited to, use of the present invention as a building support mechanism to reinforce, separate, measure, and the like. A joiner includes, but is not limited to, use of the present invention as a building support mechanism to reinforce, tie, support, join, and the like. The positions are based on the direction of pin up 14 or pin down 18. The pin of the invention includes but is not limited to the protruding portion which has been chamfered, beveled, furrowed, or grooved to allow for ease of modular block placement.

Figure 1B:
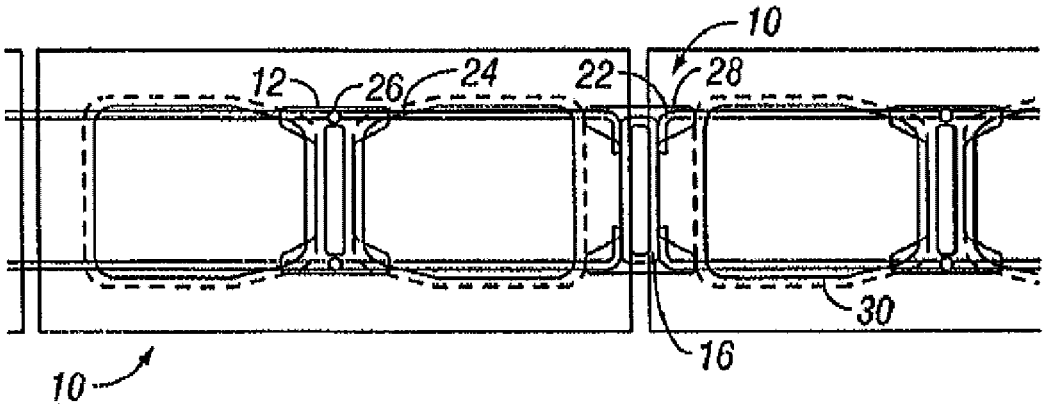

FIG. 1*b* shows a top view of the up position as separator 12 and joiner 16. In pin up position 14, the invention is placed latitudinally across the top of the modular block and is connected with a connector, including but not limited to track connectors or wires 20, which run up and through grooves 24 and holes 26 (see FIG. 1*b*) for connection to the modular blocks and to the next joiner 16.

In pin down position 16, the joiner is placed between modular blocks and connected with connectors, which run through the grooves. Legs 22 are bent and press into modular block material mating grooves 28 for further stability and bent legs 22 are tapped into the grooves of modular block 30 and then can accept connectors, including wire. This system resists the tensile forces on the connectors and allows the continuous and uniform support of the wall unit. The present invention may also be used as a vertical separation and joining system.

Figure 2A:
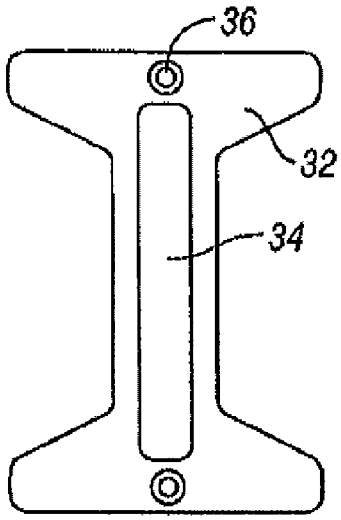
FIGS. 2*a-e* are additional views of the first embodiment.
Figure 2B:
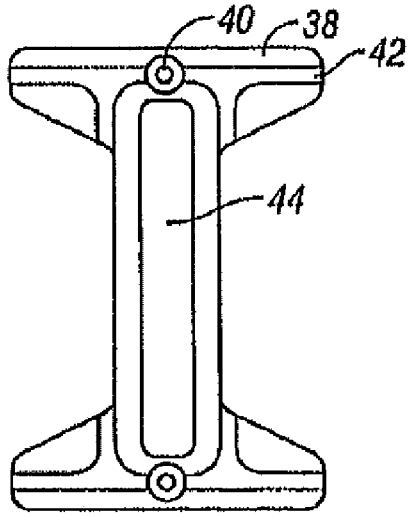
Figure 2C:
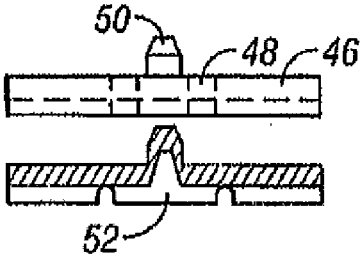
Figure 2D:
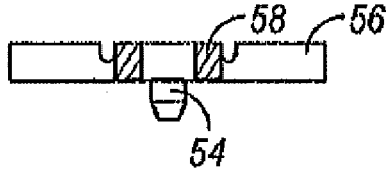
Figure 2E:
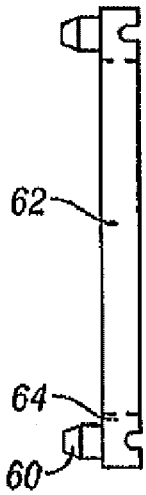

FIGS. 2*a* through 2*e* show different views of the invention including sectional views. FIG. 2*a* shows the invention in the up position as separator 32 with pin 34 facing up and holes 36 for any connectors. FIG. 2*b* shows the invention as joiner 38 in pin down 44 position. Holes 40 and grooves 42 allow for connectors to run up and through completing the system. FIG. 2*c* is a side view of separator/joiner 46 in the pin up position 50, showing the grooves/holes 48 for connection. FIG. 2*c* also shows the opening 52 which allows for the separator/joiner to be nested and stacked for ease of shipping and handling. FIG. 2*d* is a diagram of separator/joiner 56 in pin down 54 and grooves/holes 58 for connection. FIG. 2*e* is a side view of the separator/joiner 64 in a vertical pin position 60 holding a vertical modular block 62.

FIGS. 3*a* and 3*b* are additional views of the separator/joiner connection system in use with modular blocks. Separator 66, 72 in pin 68, 80 up position, latitudinally placed within modular block 70 with grooves 74 for connectors 86 and joiner 76 in pin 82 down position with bent legs 78 are shown in FIGS. 3*a* and 3*b*.

Figure 5:
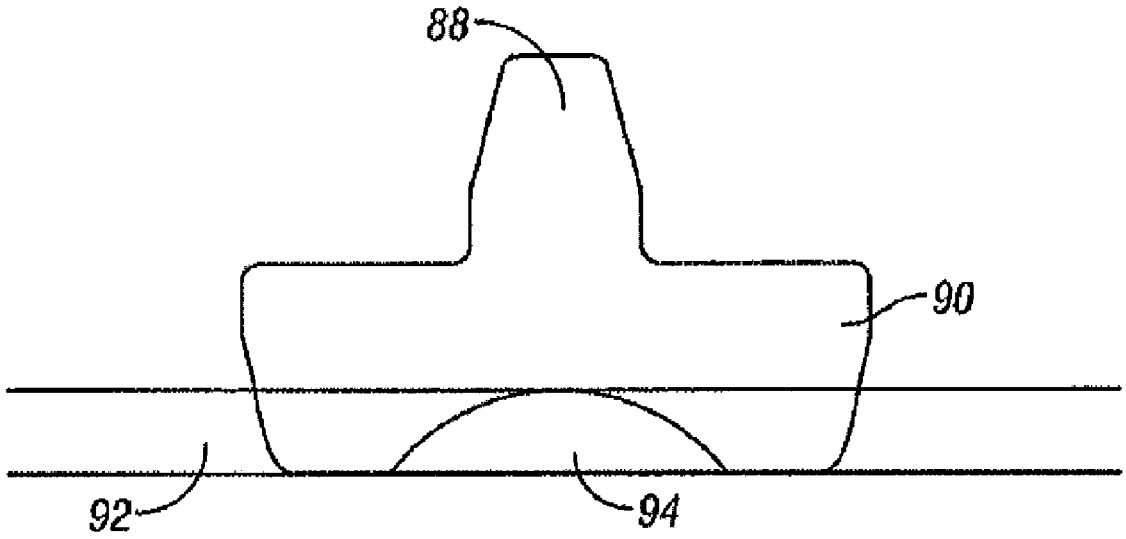
FIG. 5 is a side view of a second embodiment of the separator/joiner of the invention.

Separator 66, 72 in pin 68, 80 up position, latitudinally placed within modular block 70 with grooves 74 for connectors 86 and joiner 76 in the pin down position with bent legs 78 are shown in FIGS. 4*a* and 4*b*, in another view. FIG. 5 shows an alternative embodiment of separator/joiner 90 in pin 88 up position. Connector 92 runs through groove 94 to complete the system.

Figure 6A:
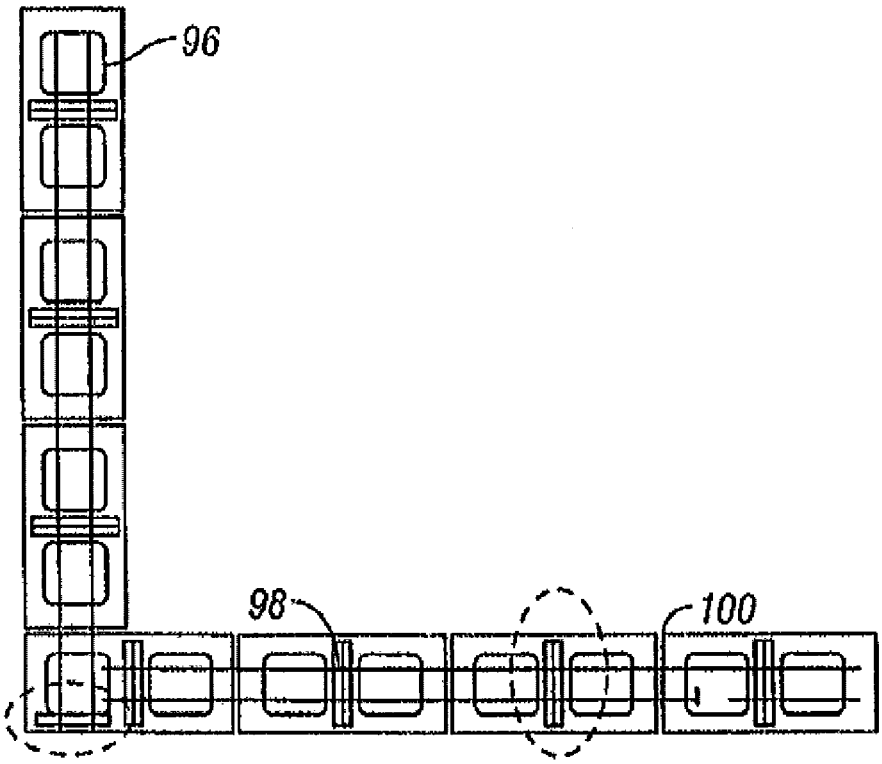
FIGS. 6*a* and 6*b* are views of a preferred seperator/joiner connection system of the invention in conjunction with stacked modular blocks.
Figure 6B:
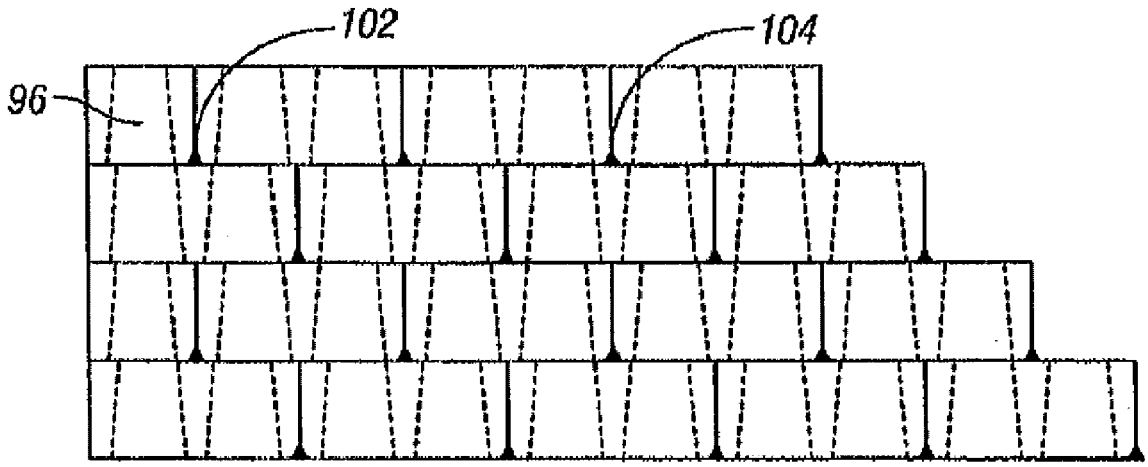

FIGS. 6*a* and 6*b* show a preferred embodiment of the separator/joiner connection system. The system comprises two strands of rigid metal wire onto which are crimped at precise intervals a "T" configured separator which provides a seat for modular sized masonry units. The "T" separator is preferably manufactured of a rigid, non-porous, man-made material that is rated to support the weight stresses of the wall units where they are used. The respective ends of each length of stranded separators are (1), closed by a separator and, (2), open on both strands in order to enable the connection with the next tie unit. There is optionally a corner clip that is provided for the purpose of tying at right angles. The length of the overall unit, and the intervals between the "T" separators vary in accordance with the modular sizes of the various masonry units, e.g. 4"×4"×16"; 8"×8"×16"; 2"×4"×8"; etc.

FIG. 6*a* shows modular block 96 with latitudinally placed separator 98 connected by connectors 100. Connectors 100 preferably comprise 9 gauge wire (or smaller), but may comprise cold roll, e.g. with a 3/16 diameter. The connectors are preferably straightened using a straightener during product manufacture. As can be seen, the inclusion of the present invention in the wall does not impede any vertical rebar that may be placed in the cells (i.e. openings) of the CMUs. However, the wires or rods are preferably close enough so that they are within the cell area, and are thus incorporated in the vertical pour. Because the connectors provide tensile strength, they can reduce the need for vertical rebar, and may require less frequent vertical pours, for example only every fourth block.

Figure 7A:
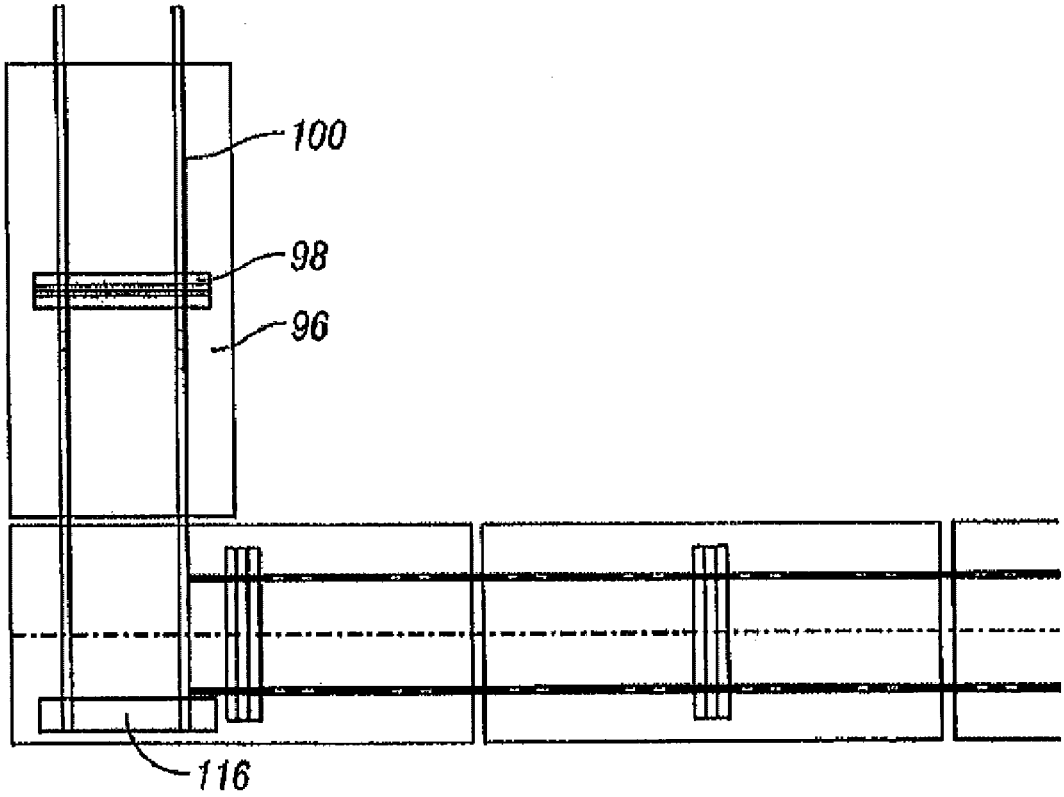
FIGS. 7*a-c* are detailed views of the embodiment of FIG. 6(*b*)
Figure 7B:
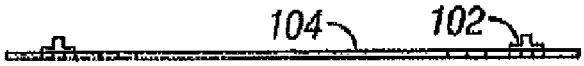
Figure 7C:
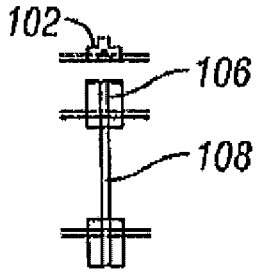

FIG. 6*b* shows an elevation view of modular blocks 96 with separator 102 and connector 104. FIGS. 7*a* through 7*c* show a detailed view of this embodiment. Modular block 96 with latitudinally placed separator 98 and connector 100 are shown in FIG. 7*a*. In FIG. 7*b*, separator 102 with connector 104 shows the basic rail system of the present invention. The rail system is also shown in FIG. 7*c* in separator 102, 106 and connector 108.

Figure 8A:
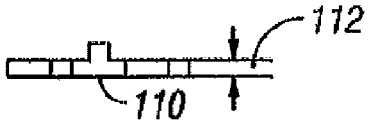
FIGS. 8*a-f* show further alternative embodiments.
Figure 8B:
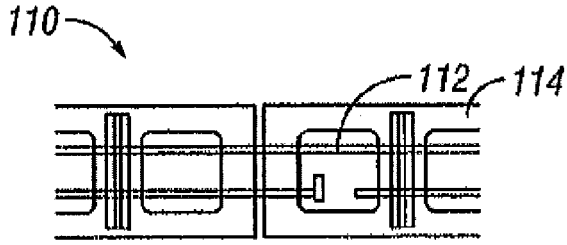
Figure 8C:
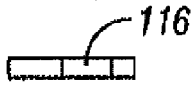
Figure 8D:
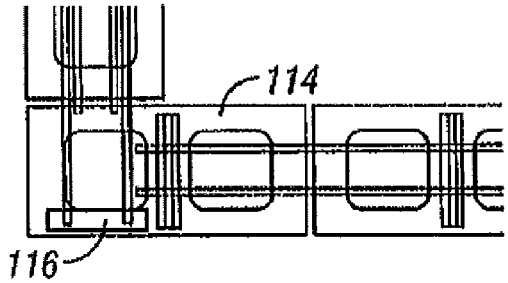
Figure 8E:
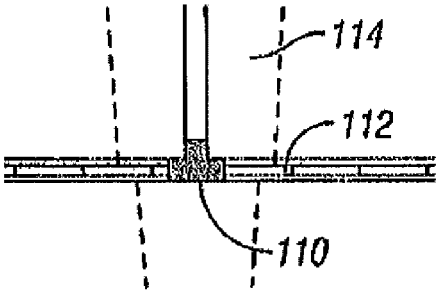
Figure 8F:
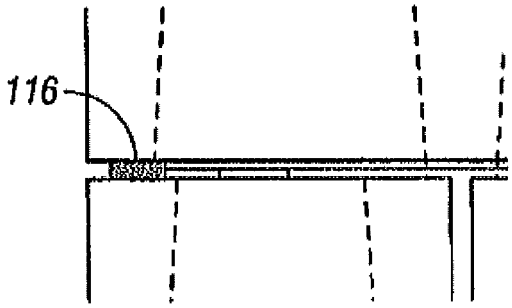

FIGS. 8*a* through 8*f* show different views of alternative embodiments of the present invention. FIGS. 8*a*, 8*b*, and 8*e* show an alternative embodiment of the system that is similar to the preferred embodiment. Separator/joiner 110 uses grooves and holes for connector 112 to connect modular blocks 114. FIGS. 8*c*, 8*d* and 8*f* show an embodiment using flat corner clip 116 to allow for a smooth corner transition. Flat corner clip 116 optionally utilizes connectors 112 to connect modular blocks 114 at the corners. Preferably a single rail unit (which is preferably four feet long to cover three standard CMUs, but can be any length), does not have a spacer at either end; the user can provide a flat corner clip if desired, or a standard "T" clip if the unit is to be joined to another unit, for example to form a long wall.

Figure 9A:
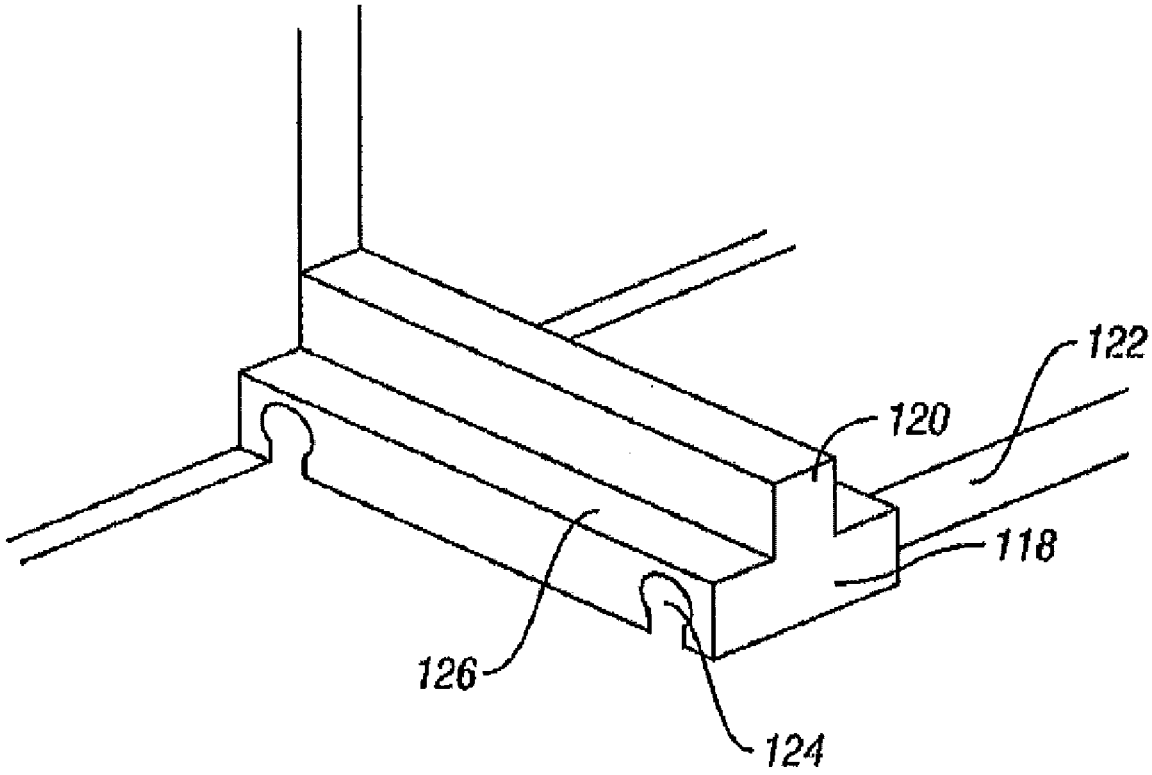
FIGS. 9*a* and 9*b* are views of a T-clip embodiment of the invention.
Figure 9B:
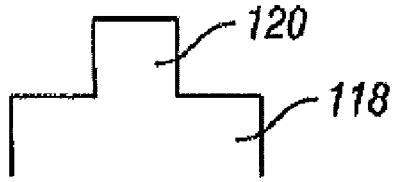

FIGS. 9*a* and 9*b* show a detail of the "T" clip of the present invention. FIG. 9*a* shows a cross view of the separator/joiner 118 with pin 120 up position and connector 122 for the rail system, holes 124 and grooves 126 for connection and modular block placement. FIG. 9*b* is a side view of alternative embodiment of separator/joiner 118 in pin 120 up position and pin 120 in both FIGS. 9*a* and 9*b* has not been chamfered. The grooves for the rods may comprise the shape shown, or may simply be arched with straight side walls. Preferably the rods or wires may be snapped, tapped, or slid into the grooves in the field. The "T" clip preferably comprises a marking in the middle of the bottom side, so the user can easily snap a clip onto the ends of wires so they extend only halfway into the clip grooves; thereafter an adjacent unit's wires may be snapped in the remaining half, thereby extending the present system to any desired length.

Figure 10:
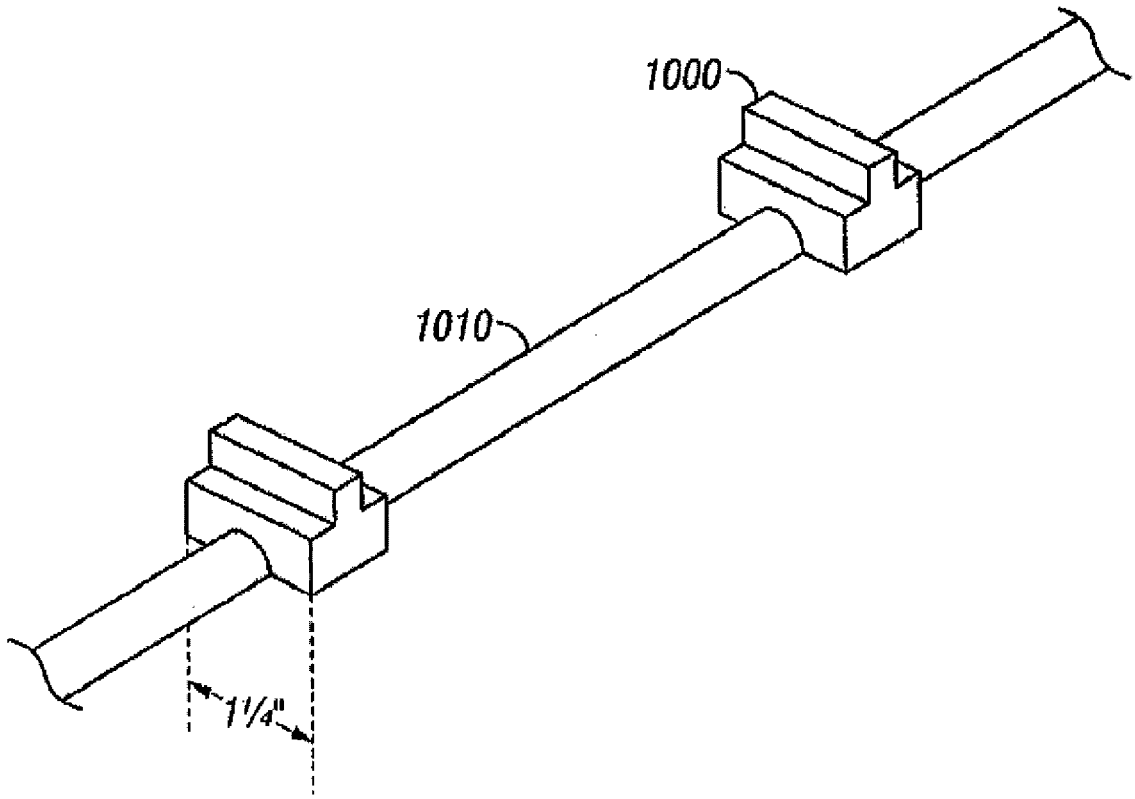
FIG. 10 is a view of a single-strand version of the T-clip used in conjunction with a single connector.

Another embodiment of the present invention is similar to the previous embodiment, except that single "T" clip 1000 is wide enough to hold only one connector (rod) 1010. One strand, or continuous filament masonry tie, of this embodiment is shown in FIG. 10. A preferred width is 1.25", but any width could be used. The wider the clip, the safer the construction and the easier it is to install, but placement is limited as described below. During construction, two such strands are preferably used side by side; they are aligned parallel by the faces and shoulders of the "T" clips placed against the modular blocks. The strands are preferably placed so that they are both within the cell area and are thus incorporated into the vertical pour. However, one strand may optionally be moved closer to the center, or to any position, so it can be tied to the vertical rebar (using, for example, tie wire) as required by the architect. Such flexible placement is limited only by the width of the clips, which set the minimum separation distance between the strands.

Because the spacing is variable, any width modular block may be accommodated by just one product configuration. (According to the previous embodiment, multiple "T" clips must be manufactured and stocked to correspond to different sized modular blocks, for example bricks.) Any width modular blocks are accommodated by varying the number of parallel strands laid. For example, for pilaster or other wide block, 3 strands can be used, while for brick, for example 2"×4"×8" brick, only one strand need be used. Once a spacing is chosen, an installer may easily use a spacing gauge for ease of installation.

The strand of this embodiment may be used to reinforce vertical brick veneer walls and decrease the laying time. First, two approximately parallel narrow grout beds are laid down along the length of the wall; they should be approximately as far apart as the depth of the brick, and have a space between them. A single strand is then laid down in the space between the grout beds, and the bricks are laid according to the present invention. In this way, the strand does not interfere with the two grout beds or with buttering the vertical edges of the bricks.

Another advantage of this embodiment is that triple the amount of the previous embodiment can be shipped in the same size package.

Figure 11:
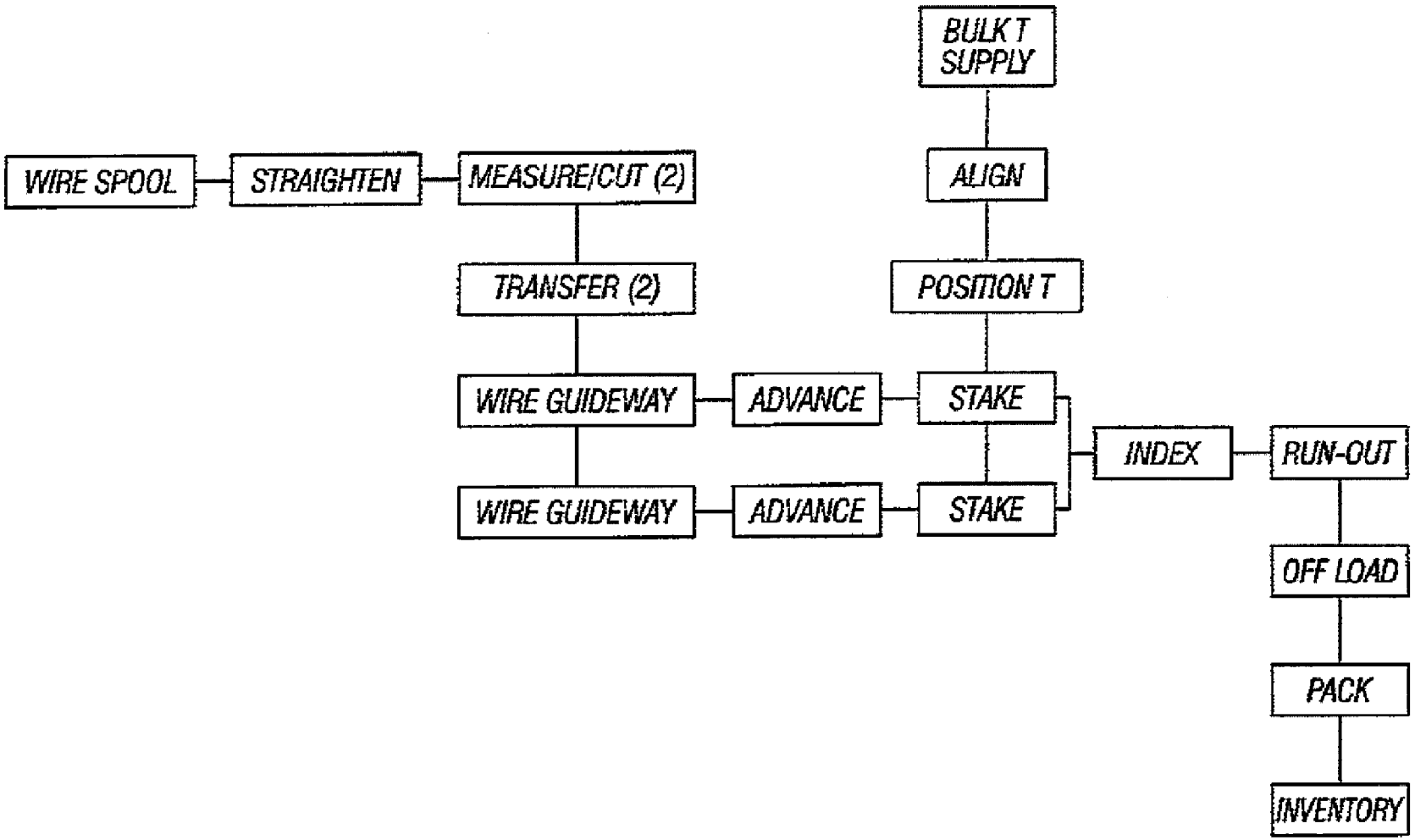
FIG. 11 is a flow diagram of a method of a factory floor layout according to the invention.

FIG. 11 is a schematic of a method for a factory floor layout according to the present invention.

Embodiments of the present invention have advantages which may include, but are not limited to: providing a continuous tie between building materials; automatically leveling and spacing the modular blocks during laying; providing continuous horizontal reinforcement to each modular block course where a reinforcement or tie line is used; expediting and reducing the laying time, especially the time expended in the leveling or plumbing of each individual modular block; increasing the structural integrity of a modular block, including but not limited to walls and other similar structures (hereafter referred to as a "wall unit(s)"), by significantly decreasing the potential for horizontal or vertical separation between the individual modular block; providing uniform and consistent, horizontal and vertical joint spacing throughout the wall units; providing additional wall unit stability and strength at each modular block point where vertical joining material or fill is used; and providing an easy and efficient method for professional or non-professional use.

The automatic spacing of embodiments of the present invention allows blocks to be laid without mortar, and then after the construction is complete, plaster or stucco may be sprayed on. Unlike standard modular block construction, the wall sides do not need to be covered with a material, such as masonry adhesive, prior to spraying in order to hide the mortar joints, since there is no mortar. If the vertical pour is thick enough, then it will not come to the surface of the wall. Thus only one step is needed to coat a wall; the final color applying step may also be eliminated.

The present invention may alternate in different configurations, may be placed in the same direction, or may be spaced as appropriate to the building or wall unit. Additionally, the present invention is preferably easily stackable for shipping, handling and other moving.

Alternative embodiments of the present invention include spacers, joiners, and separators in any shape appropriate for the modular blocks. These include but are not limited to any variation in the pin, chamfered or square, grooves, holes and hole placement, and the like.

Another alternative embodiment of the invention includes building wall units with multiple pours, bars instead of pins, and clips includes as supports or corner support.

Alternative embodiments of the present invention include non-injection molded fabrication, use of alternative materials for the present invention, including but not limited to those appropriate for environmentally friendly substitute building materials. Other alternative embodiments are use of the present invention as an artistic component of building such as exposed trusses, or as temporary structural supports for alternative applications including but not limited to camping, mobile or prefabricated homes, or tents/structures for special events.

Embodiments of this invention provide greatly increased resistance to explosions, blasts, wind, and seismic activity, as shown in Ho, C. K., et al., *Finite Element Stress Analyses of Ties for Masonry Applications: Final Report for The Arquin Corporation*, SAND2005-5877, Sandia National Laboratories, NM (Aug. 18, 2005), incorporated herein by reference.

Multiple Wall Construction

Figure 12A:
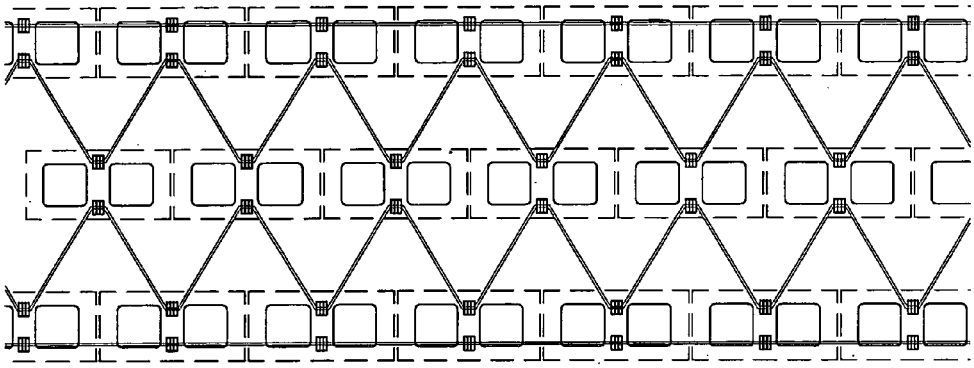
FIG. 12*a* is a top view of a multi block wall using offset multiwall reinforcement ties.
Figure 12B:
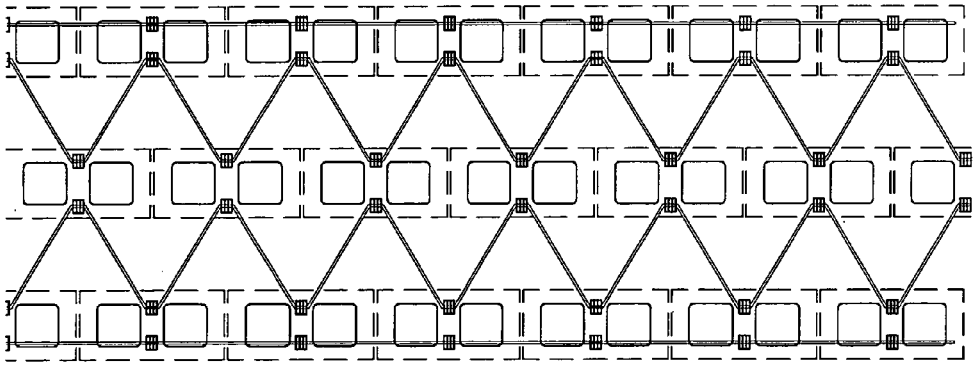
FIG. 12*b* is top view showing the spacing of the multiwall reinforcement ties.

The present invention may be adapted for use with multiple parallel walls, which provides much higher compressive stress resistance and a greatly increased factor of safety (FOS) over single wall construction, such as required in many military force protection applications. As shown in FIG. 12, it is preferable that the straight sections of the parallel walls are laid so that the vertical joints between blocks in one wall are offset from the vertical joints between blocks in an adjacent wall. Two adjacent walls are preferably tied together during construction as shown, using a preferably continuous offset tie which is bent as desired. As shown in FIG. 12, if the continuous offset tie extends only just past the inner facing surfaces of the walls, as shown, it is preferable to utilize a single strand continuous tie along the outer edge of each wall. The walls may be touching or spaced any distance apart. The offset nature of the walls is preferably because this configuration minimizes compaction separation transferred from one joint to an offset joint. The volume between two adjacent walls may optionally be at least partially filled with grout or cement, for example ⅜ pea grout or aggregate, thereby forming a single monolithic wall.

Figure 13A:
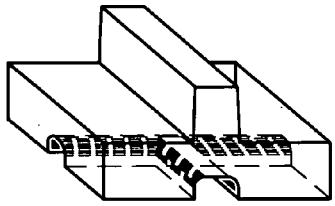
FIG. 13*a* is an isometric view of a standard bench/bowtie clip.
Figure 13B:
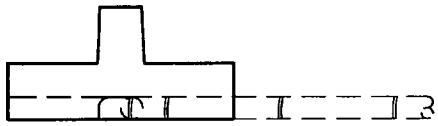
FIG. 13*b* is an end view of the standard bench/bowtie clip.
Figure 14A:
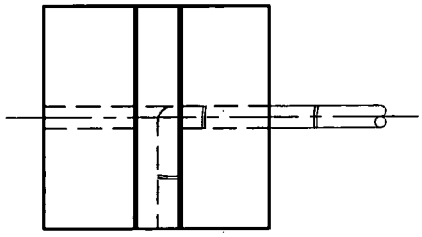
FIG. 14*a* is a top view of the standard bench/bowtie clip.
Figure 14B:
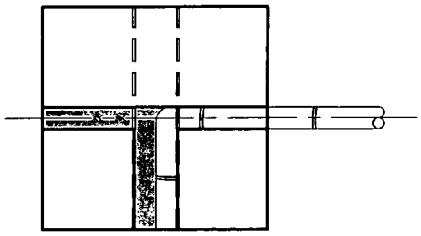
FIG. 14*b* is a bottom view of the standard bench/bowtie clip.

Each bend portion of the offset tie preferably comprises a short segment parallel to the direction of the wall, onto which a standard bench/bowtie clip is clamped or otherwise attached. The segment is preferably just slightly larger than the width of the clip. The manufacturer preferably installs the clips, but others including the installer may alternatively install them. Various views of a standard bench/bowtie clip of the present invention are shown in FIGS. 13-14. The same clip may be used anywhere along a straight (single strand) or offset tie, even at the end of the wall, thus simplifying manufacturing requirements. The vertical protrusion on the clips preferably serves as a spacer to automatically space the next layer of blocks to be laid.

The present invention is preferably sold in assembled units of a desired length. One end of each unit optionally comprises an end clip with one half of the channel empty, in which case the other end would preferably comprise bare tie. Thus, in order to join two units in series, the bare end from one unit would be tapped into the open channel of the end clip. Alternatively, all ends are bare, and the installer taps the clip onto both bare ends after the ends have been lined up. As shown in FIG. 14, the bare tie end of each unit may optionally comprise a right angle. The shaded area is open for installing an adjacent unit, also comprising a right angle tie end. This improves the rigidity and strength of the construction.

Figure 15A:
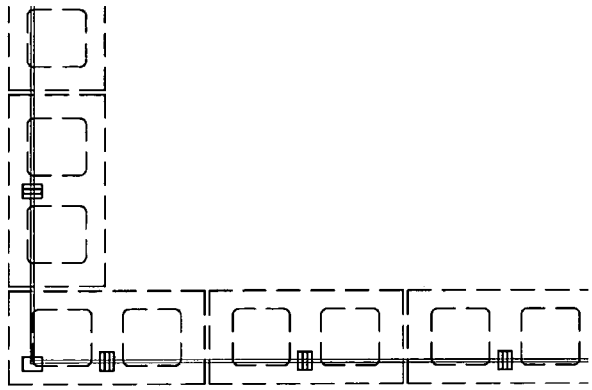
FIG. 15*a* is a top view of a corner installation of a standard end wall clip of the present invention.
Figure 15B:
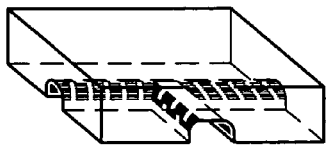
FIG. 15*b* is a perspective view of a standard end wall clip of the present invention.
Figure 16A:
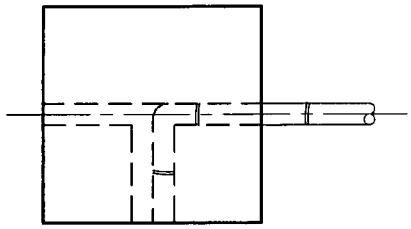
FIG. 16*a* is a top view of the standard end wall clip.
Figure 16B:
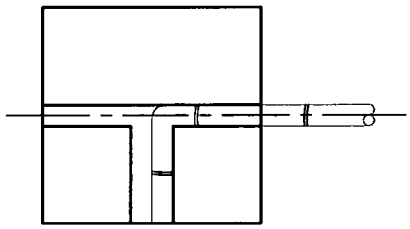
FIG. 16*b* is a bottom view of the standard end wall clip.

Corner pieces and installations are shown in FIGS. 15-16. The corner "end wall" clip is preferably identical to a standard bench/bowtie clip, but without the vertical protrusion. It is preferable that corner clips are installed in the field during assembly.

Figure 17A:
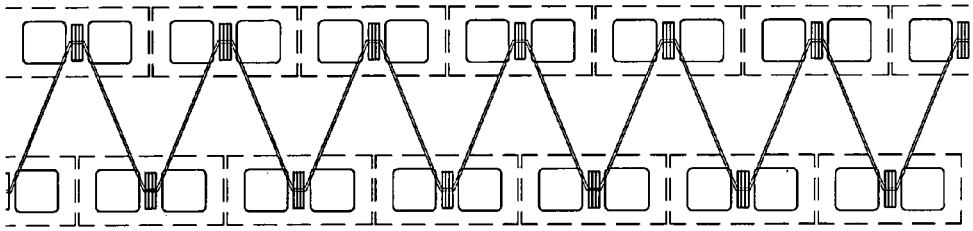
FIG. 17*a* is a top view of an alternative embodiment of the double block wall.
Figure 17B:
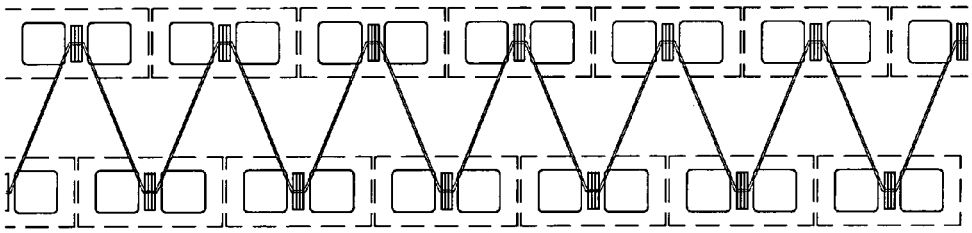
FIG. 17*b* is an a top view of an alternative embodiment showing the spacing of the doubl wall reinforcement tie.
Figure 18A:
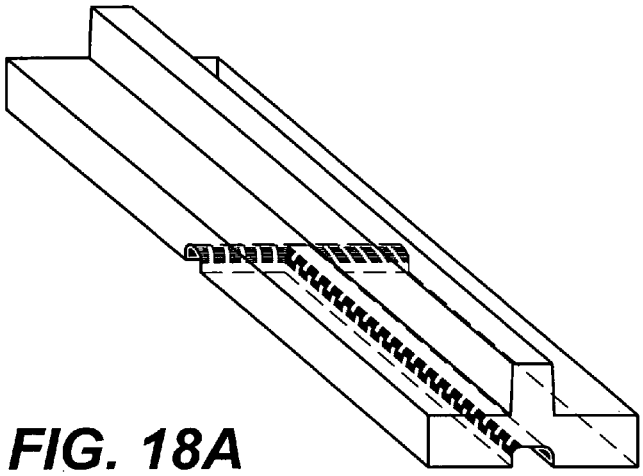
FIG. 18*a* is an isometric view of the double wall bench/bowtie clip.
Figure 18B:
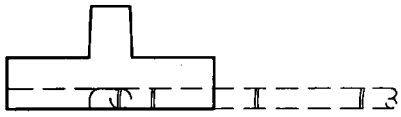
FIG. 18*b* is an end view of the double wall bench/bowtie clip.
Figure 19A:
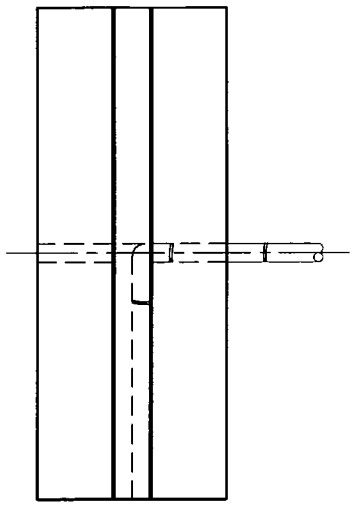
FIG. 19*a* is a top view of an alternative double wall bench/bowtie clip.
Figure 19B:
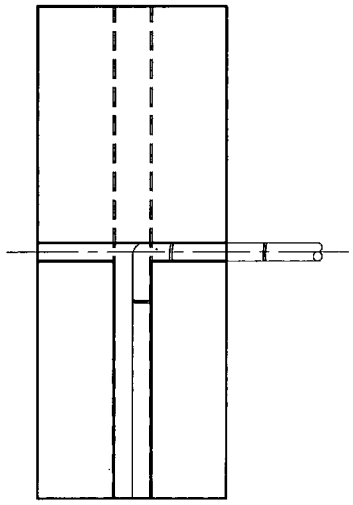
FIG. 19*b* is a bottom view of an alternative double wall bench/bowtie clip.

In an alternative embodiment shown in FIG. 17, if the offset filament continuous tie is clipped at or near the centerline of each wall, then the single strand continuous filament tie (shown in FIG. 12) is preferably not used. In this embodiment, it is preferable to use larger bench/bowtie clips, depicted in FIGS. 18 and 19, as described above. Corresponding end wall clips may also be used as described above.

Weld-Joint System

FIGS. 20-23 depict another embodiment of the present invention. The present invention provides precise on center (OC) construction, which is the exact center of the separator affixed to the filament(s). For example, 16 inch OC is used in order to accommodate a block that measures 7⅝ inches by 7⅝ inches by 15⅝ inches. Since there is a ⅜ inch variance from the block dimension of 8"×8"×16", it is possible for the vertical/horizontal junctures to incorporate a joint of ⅜ inch thickness throughout. It is this space that the separator controls for perfect plumb and level as the wall structure is built. The OC will vary at the assembly point given different sizes of CMU in both domestic and international consumer spheres.

This embodiment comprises continuous filaments, separator units, and end clips, which are preferably formed into a unified welded assembly as the finished product. The length of the filaments is determined by the dimensions of the CMU it is going to accommodate. For example, eight and twelve foot long assemblies are preferably used in conjunction with 8×8×16 inch blocks, since this CMU measurement fits three blocks per each four foot dimensional length. One end of the filament preferably has a separator unit affixed while the opposite end preferably does not, in order to make possible joining of assemblies in precisely measured sequence. The ends of each assembly preferably form a "lock" by being bent at right angle at the connecting juncture.

Each separator unit is preferably composed of a metal strand with an injection molded plastic inverted "T" at each end (bowtie clip). A preferred assembly is detailed in FIG. 22. The strand length is determined by the thickness of the wall structure, e.g. 6" fence block, 8" inch standard CMU, or 10" pilaster block. The plastic component (bowtie clip) remains the same dimension regardless of the wall thickness. The separator units can be manufactured as independent units where there is no requirement for resistance to lateral loading, e.g. for a residential perimeter block fence, which construction would still provide the benefits of perfect alignment of CMU in terms of plumb (vertical) and level (horizontal) placement, decreased labor/lay-up time, and low skill requirements for the layman constructor.

Figure 20A:
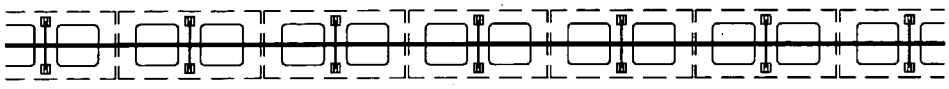
FIG. 20*a* is a top view of a continuous bar tie—single strand.
Figure 20B:
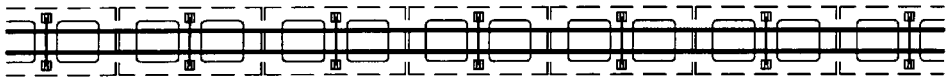
FIG. 20*b* is a top view of a continuous bar tie—double strand.
Figure 21A:
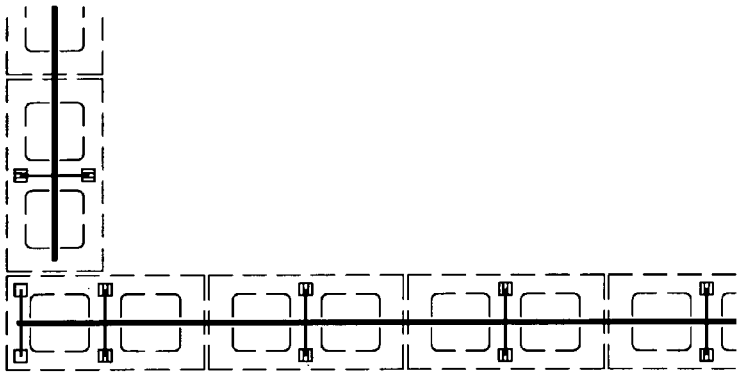
FIG. 21*a* is a top view of a continuous filament masonry using a strand.
Figure 21B:
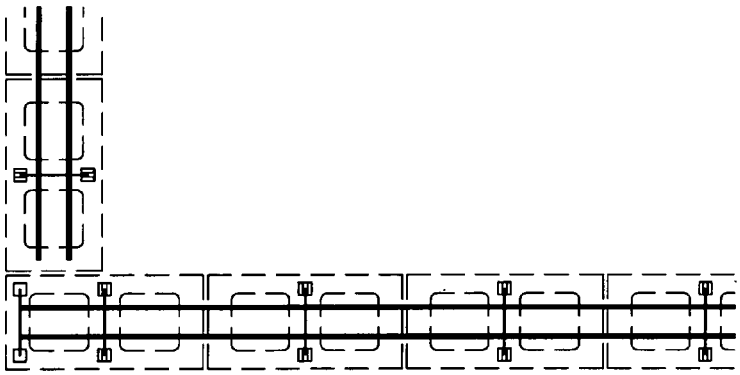
FIG. 21*b* is a top view of the continuous filament masonry using a double strand.
Figure 22A:
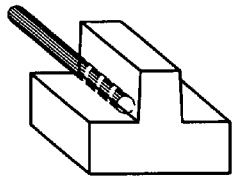
FIG. 22*a* is a isometric view of the stand bench/bowtie clip in use.
Figure 22B:
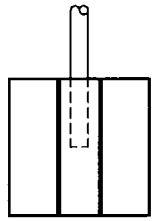
FIG. 22*b* is a plan view of the standard bench/bowtie clip in use.
Figure 22C:
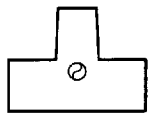
FIG. 22*c* is an end view of the standard bench/bowtie clip in use.
Figure 23A:
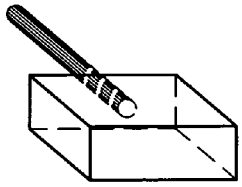
FIG. 23*a* is an isometric view of an alternative embodiment of the standard end wall clip of the present invention.
Figure 23B:
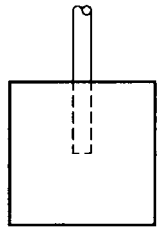
FIG. 23*b* is an plan view of an alternative embodiment of the standard end wall clip of the present invention.
Figure 23C:
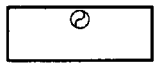

As shown in FIGS. 20-21, the separator units are preferably spot welded, or otherwise welded, to the continuous strands at right angles and at precise OC given the CMU dimensions of wall structure. A multiple "spot" welding process is likely to be most economical, since it enables fast mass production. The entire assembly is preferably distributed to the end consumer along with end clips which are preferably unattached. The end clips are preferably used as take-off points at beginning of each filament sequence. The assembly is preferably designed to be stacked, tied and delivered to end consumers in package formats appropriate for truck/rail shipment that provide for defect-free delivery.

Improvements of this embodiment over the previously described embodiments include: significant reduction of plastic product in the bench separator, and thus less manufacturing cost; increased mass production capability through a multiple spot-weld assembly process; weld joints at every juncture increase the strength of assembly over the pressed-on plastic to filament design; eliminated tendency by plastic product to "spin" on the filament; easier stack/wrap capability for purposes of shipping; more feasible to construct a wide assembly configuration, such as for wider pilaster CMUs (e.g. 10" or 12" width); separator units may be manufactured singly for customer use where added strength of filament is not a requirement; and easier integration/composite applications with tie systems from other manufacturers.

Figure 24A:
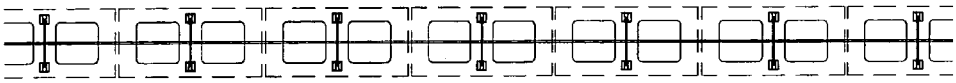
FIG. 24*a* is a top view of the single strand embodiment of the continuous bar tie of the continuous bar tie of the invention.
Figure 24B:
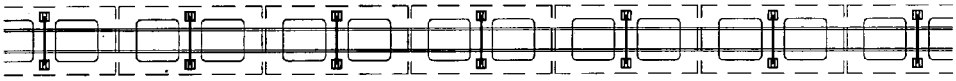
FIG. 24*b* is a top view of the double strand embodiment of the continuous bar tie of the invention.

FIG. 24 shows alternative single and double strand embodiments for use with a single wall. The continuous strand preferably comprises 0.25 cold roll steel, but optionally any size wire may be used. Although cold roll has good corrosion and oxidation resistance, the continuous strand may optionally be hot dip galvanized. The variable diameter cross wire between two standard bench/bowtie clips is optionally 9 gauge, although any diameter or material wire may be used. The cross wire is preferably welded or spot welded to the continuous strand.

Figure 25A:
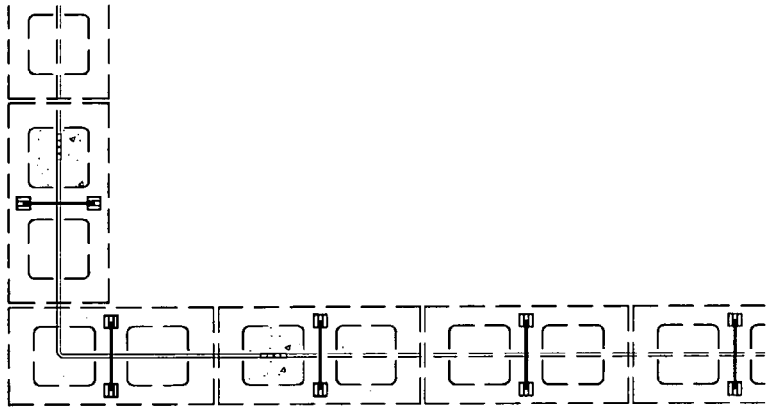
FIG. 25*a* discloses a top view of the corner configuration of the single strand embodiment of the continuous bar tie of the continuous bar tie of the invention.
Figure 25B:
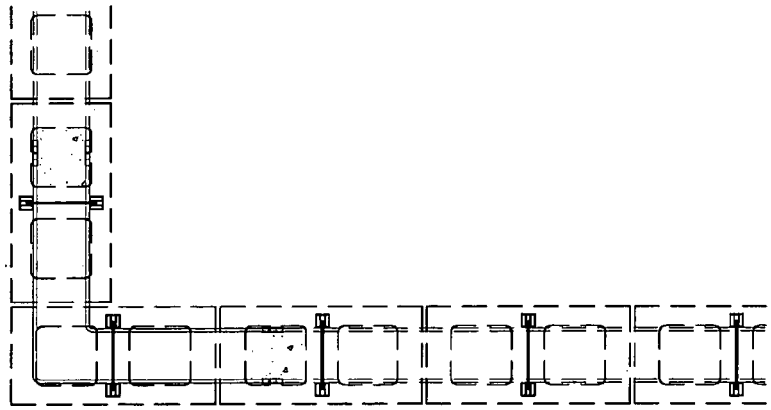
FIG. 25*b* discloses a top view of the corner configuration of the double strand embodiment of the continuous bar tie of the invention.
Figure 26A:
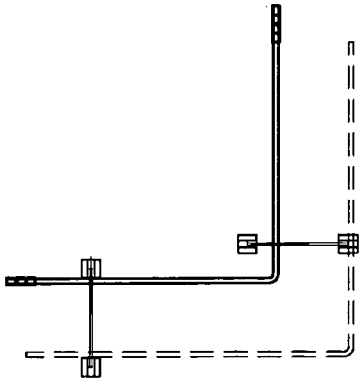
FIG. 26*a* is a top view of a left corner unit of the present invention.
Figure 26B:
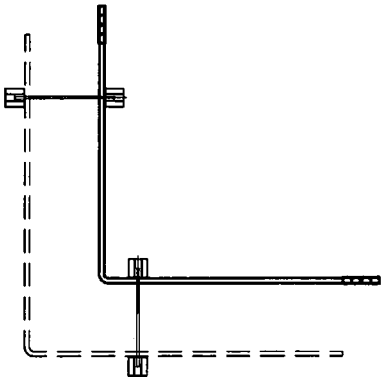
FIG. 26*b* is a top view of a right corner unit of the present invention.
Figure 27A:
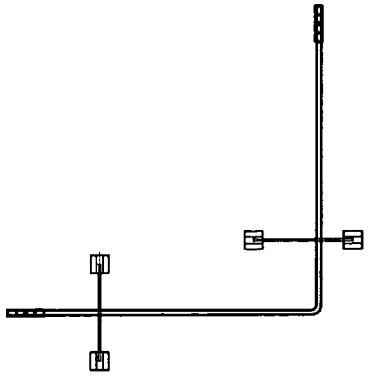
FIG. 27*a* is a top view of a differently sized left corner unit than from FIG. 26*a*.
Figure 27B:
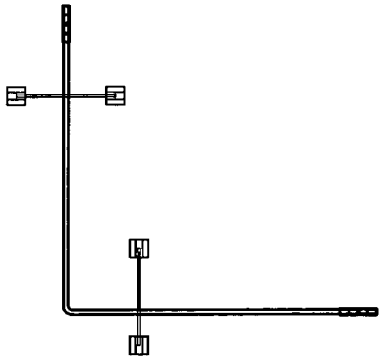
FIG. 27*b* is a top view of a differently sized right corner unit than from FIG. 26*b*.
Figure 28A:
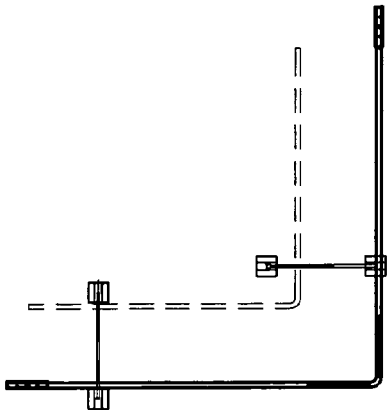
FIG. 28*a* is a top view of a differently sized left corner unit than from FIG. 27*a*.
Figure 28B:
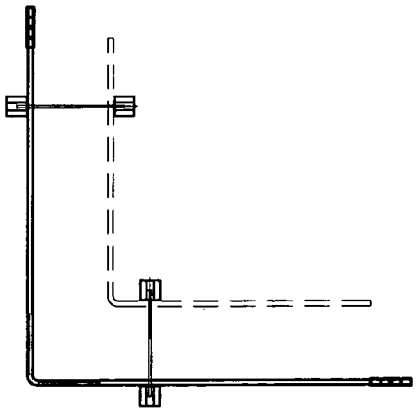
FIG. 28*b* is a top view of a differently sized right corner unit than from FIG. 26*b*.

Embodiments of corner configurations for these embodiments are shown in FIG. 25. The strand or strands that run parallel to the length of the blocks are preferably continuous as they round the corner. The "Connection by Others" preferably comprises a coupler, but may comprise any type of connector that couples wires end to end, including but not limited to a crimp or other deformation-type coupler. Details of the three different continuous corner sections (90-16-CBT-SS, 90-18-CBT-SS, and 90-14-CBT-SS) are shown in FIGS. 26-28. A particular section is chosen depending on whether the application is single strand or dual strand, and, if dual strand, if the corner strand is inner or outer. Note that the lengths of these units may be different, for example depending on the CMU size or any building code requirements.

Figure 29A:
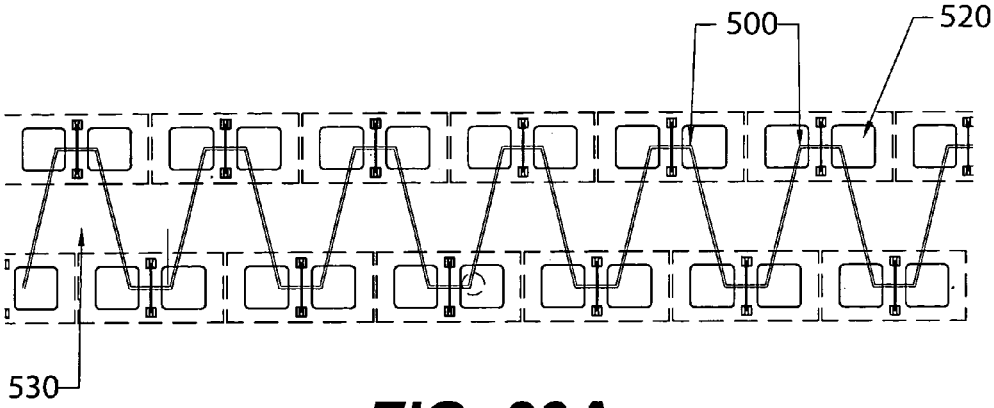
FIG. 29*a* is a top view of a double DMU wall.
Figure 29B:
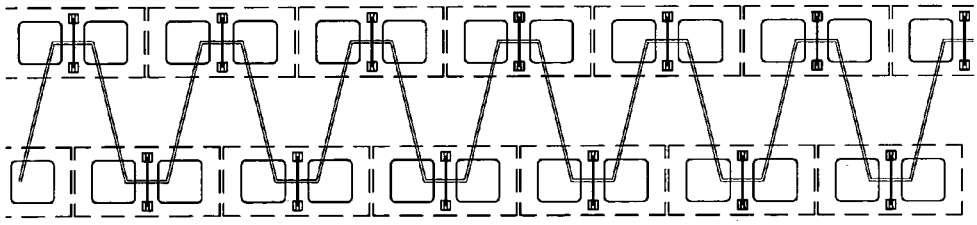
FIG. 29*b* is a top view showing the continuous bar tie spacing.

FIG. 29 shows an alternative double wall embodiment of the present invention. In this embodiment, at least part of continuous strand 510, such as bends 500, preferably overlap empty cells 520, so that those overlapping portions are encased in concrete when the cells are filled. The design of this system has some built-in flex, which can accommodate a force such as wind or an explosive blast. Space 530 between the walls may be empty or filled with unconsolidated rock (such as ¾" rock), sand, insulation, or any type of fill. Alternatively, a layer of wire mesh or expanded metal may be disposed across both inner and outer walls.

Figure 30A:
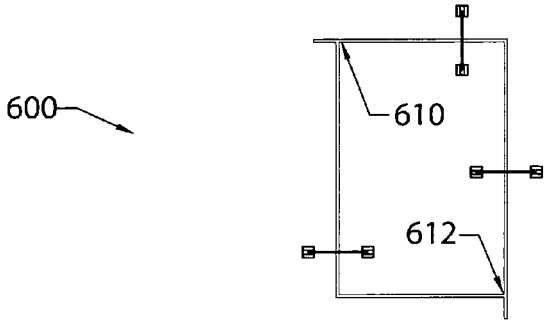
FIG. 30*a* is a top view of a double wall corner connection.
Figure 30B:
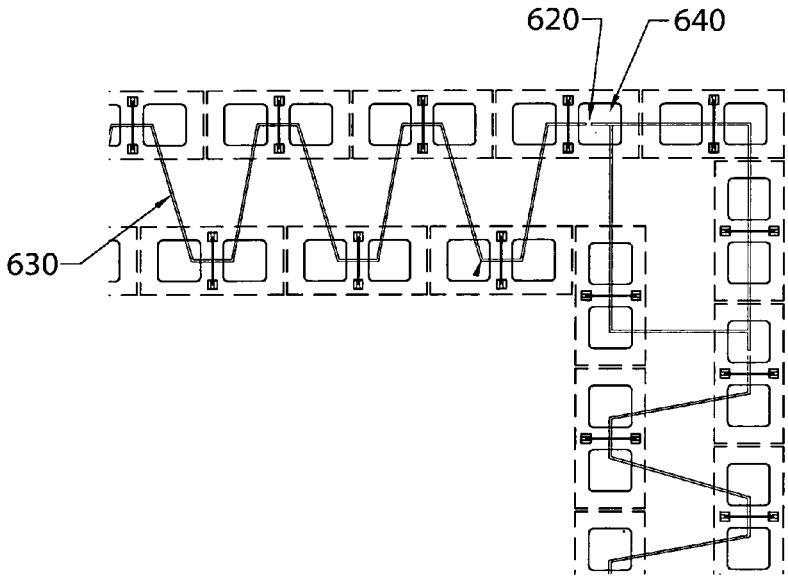
FIG. 30*b* is a top view of another embodiment of the double corner wall corner connection.

FIG. 30 shows double wall corner connection 600 in accordance with the present invention. The connection greatly strengthens the double wall configuration. Corner connection 600 preferably comprises a rectangular wire loop and may be fabricated in any manner, such as welding two "L" shaped wires together at weld points 610, 612. Corner connection 600 is preferably symmetrical so it can be flipped and used in any corner. Corner connection 600 preferably connects to continuous strand 630 at a connection point 620 (optionally via a coupler or crimp) which is over an empty cell 640. Corner connection 600 may be any length or size, for example to accommodate different CMU sizes, different spacing between the block walls, or code requirements. Each corner connection 600 preferably connects the inner wall and outer wall together in each block layer, and is aligned with the corner connections above and below it, thus greatly strengthening the entire structure.

Figure 31A:
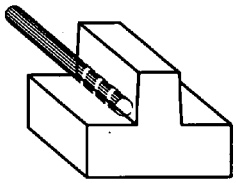
FIG. 31*a* is an isometric view of a pre-molded standard bench/bowtie clip.
Figure 31B:
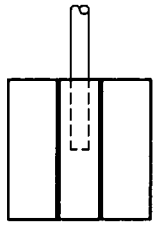
FIG. 31*b* is a plan view of the standard bench/bowtie clip.
Figure 31C:
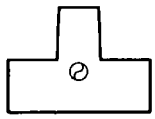
FIG. 31*c* is an end view of the standard bench/bowtie clip.
Figure 32A:
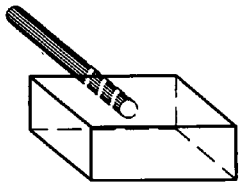
FIG. 32*a* is an isometric view of a pre-molded end wall clip.
Figure 32B:
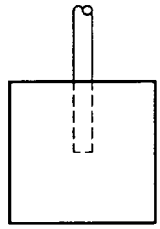
FIG. 32*b* is a plan view of the pre-molded end wall clip.
Figure 32C:
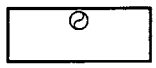
FIG. 32*c* is an end view of the pre-molded end wall clip.

FIG. 31 shows an embodiment of a standard bench/bowtie clip of the present invention, and the fitting of a cross wire therein. Such clips strengthen the structure and align the next layer of modular blocks. FIG. 32 shows an embodiment of a standard end wall clip of the present invention, which is preferably identical to the clip of FIG. 31 except for its lack of a vertical projection. The clips may alternatively be referred to herein as separators and preferably comprise extruded high density ABS. Many of the embodiments of the present invention show a variable diameter cross wire connected between two standard bench/bowtie clips disposed transversely across each block; the cross wire is then welded to the continuous strand (for example continuous strand 510 or 630). However, longer clips, such as the bowtie clip shown in FIG. 2 or the long bench clip shown in FIG. 9, may alternatively be used in place of the cross wire/connector combination. Such alternative clips preferably connect to the continuous strand as disclosed above.

In any of the present embodiments, the strength of the separators reduces deflection or deformation at the base of the wall. Thus high walls may be quickly constructed in accordance with the present invention, with the vertical cells (e.g. cells 520, 640) easily filled with concrete. In order to dissipate or absorb a blast or other force on the wall, most or all of the joints, either vertical or horizontal (or both), between blocks are left open (that is, un-mortared or un-grouted). Because of optional fill between walls (e.g. in space 530) in dual wall configurations of the present invention, the joints of the inner wall may optionally be mortared. In a dual wall configuration, because portions of the continuous strand (that extend between the walls) are preferably encased in unconsolidated fill, they can flex in response to a force, thus mitigating damage to both the outer wall and the adjacent wall. Thus the present invention enables rapid construction of walls that can withstand high blast loads or seismic activity.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all references, applications, patents, and publications cited above and/or in the attachments, and of the corresponding application(s), are hereby incorporated by reference.

What is claimed is:

1. An assembly for constructing and reinforcing parallel walls comprising a modular block construction, said assembly comprising:

a) a first steel wire for periodically contacting an outer wall and an inner wall of said parallel walls, said inner wall and said outer walls being constructed of a plurality of concrete modular blocks, said modular blocks being of uniform size and measurement and having two vertical cells separated by a center wall;

b) a plurality of second wires, each of said plurality of second wire comprising a smaller diameter than said first wire and shorter than a width of modular blocks of said modular block construction, thereby allowing unobstructed mortar bed application;

c) a connector disposed on each end of said plurality of said second wires;

d) a connecting mechanism, said connecting mechanism being selected from the group consisting of:

i) connector/separators composed of a high density, plastic material, said connector/separator disposed on each end of each second wire; and ii) long bench/bowties;

and wherein said first wire and said connecting mechanisms are disposed in each and every course of said modular block wall construction, part of said first wire that is disposed parallel to the wall face is disposed over empty cells of each said modular block throughout a wall structure, said part of said first wire thereby providing a reinforcement lock between said modular block to each adjacent said modular block and between said modular blocks of said opposite and parallel wall; and an angle of said first wire providing internal flexion in a space between said modular block walls, thereby increasing resistance to lateral load.

2. The assembly of claim 1 wherein a) each said second wire or said long bench bowtie clip is disposed on a first modular block across a width of said first modular block at a vertical joint between two adjacent said modular blocks in a layer above said first said modular block;

b) said connecting mechanism is disposed in a pin up position at every block juncture throughout the entire wall structure; and, c) a vertical part of said connecting mechanism is a given thickness throughout each assembly length thereby allowing unforced block placement while retaining a consistent on-center placement between said connector/separators.

3. The assembly of claim 2 wherein said connecting mechanisms are positioned to act as separators, said separators automatically aligning two said adjacent said modular blocks during construction of said layer, a length of a horizontal part of all of the connecting mechanism being the same so as to provide for a uniform level and vertical plumb as each said modular block is placed on said connector/separator; said assembly placed at precise center of each modular block in an inner wall of a dual wall structure providing for the layering of all block courses of said inner wall to be completed leaving the part of the assembly that corresponds to the outer wall exposed, thereby providing open access to the entire wall surface for application of waterproofing elements, and/or other surface coating; and, the exposed part of the assembly is positioned such that subsequent inclusion of said modular blocks of an outer wall can be placed at precise intervals on the connector/separators allowing for accurate alignment, horizontal level, and vertical plumb.

4. The assembly of claim 2, wherein said location is approximately halfway along a length of said first modular block ; and, wherein said first wire is positioned over two cells of the same modular block.

5. The assembly of claim 2, further comprising welds between said first wires and said second wires, wherein said first wire is welded or spot-welded to at least some of said second wires at contact points to space welded junctures of said first and second wires at precise intervals, said weld operation performed subsequent to connector/separator joining at each end of said second wire.

6. The assembly of claim 5 wherein said first wire is substantially perpendicular to each said second wire at said contact points; and, the alternate long bench connector/separator clip is substantially perpendicular to said first wire.

7. The assembly of claim 1 wherein at least a portion of said first wire is positioned over an empty cell of a modular block, wherein all adjacent modular blocks that contact said modular block have said first wire disposed over each cell in opposing angles thereby avoiding straight vertical alignment of said assemblies; and said opposing angles in the cells of the modular block courses above and below said assembly create a vertical placement pattern of said assemblies that provides added resistance to tensile and lateral loads to the wall surface.

8. The assembly of claim 1, further comprising a coupler, wherein said first wire is connected to a rectangular wire loop at a connection point in which said connection point is disposed over first empty cell closest to said rectangular wire loop by said coupler.

9. The assembly of claim 7 wherein said rectangular wire loop is positioned across parallel nested adjacent corners of said outer wall and said inner wall wherein a portion of said angular loop said rectangular loon joined to said assembly is exposed in each successive course, allowing unimpeded work space of the inner wall surface.

10. The assembly of claim 8 wherein said rectangular wire loop connects said outer wall and said inner wall at the point of a right angle turn, wherein said rectangular loop is disposed in opposing directions relative to said rectangular loop placement in the modular block course below said inner and outer wall corner.

11. The assembly of claim 8, further comprising at least one couple corner, wherein said rectangular wire loop is in contact with a plurality of said first wires, said rectangular loop being positioned such that a straight said first wire with coupled corner allows for use in conjunction with said angled first wire on the inside parallel margin of the inner wall and the outside parallel margin of the outer wall, and said coupled corners are spaced with said end wall clip and installed without said second wires and wherein use of said angled first wires and straight first wires in conjunction with each other will utilize the long bench bowtie clip.

12. A construction comprising:

a) an outer wall comprising a plurality of modular blocks;

b) an inner wall comprising a plurality of modular blocks;

c) a first wire periodically extending between and contacting said outer wall and said inner wall;

d) a plurality of second wires connected to said first wire;

e)two separators contacting each said second wire;

f) vertical and horizontal joints between modular blocks; wherein i) said outer wall is un-mortared, said un-mortared outer wall comprising said vertical and horizontal joints defining outer wall un-mortared joints; and ii) said inner wall is un-mortared, said un-mortared inner wall comprising said vertical and horizontal joints defining inner wall un-mortared joints; and iii) all cells in both said inner and outer walls are concrete grouted;

wherein said outer wall un-mortared joints and said inner wall un-mortared joints do not reduce the integrity and strength of the un-mortared wall in the event of lateral load conditions caused by a blast wave, said lateral loads caused by said blast wave being partially absorbed into said un-mortared outer wall and further absorbed by un-mortared joints of said inner wall thereby mitigating damage to the wall construction.

13. The construction of claim 12, further comprising construction filler material, said construction filler material selected from the group unconsolidated rock, sand, and insulation, wherein a space between said outer wall and said inner wall is at least partially filled with a construction filler material.

14. The construction of claim 12 wherein empty cells of at least some of said modular blocks are filled with concrete, and/or rebar; and the use of said rebar in conjunction with said assemblies is not impeded by said assemblies whether said rebar is placed horizontally or vertically.

* * * * *